US007999205B2

(12) United States Patent
Ito

(10) Patent No.: US 7,999,205 B2
(45) Date of Patent: Aug. 16, 2011

(54) METHOD OF SEPARATING FOREIGN PARTICLES

(75) Inventor: Mitsuhiro Ito, Tokyo (JP)

(73) Assignee: Taiheiyo Cement Corporation, Tokyo (JP)

( * ) Notice: Subject to any disclaimer, the term of this patent is extended or adjusted under 35 U.S.C. 154(b) by 939 days.

(21) Appl. No.: 11/885,673

(22) PCT Filed: Mar. 6, 2006

(86) PCT No.: PCT/JP2006/304264

§ 371 (c)(1),
(2), (4) Date: Sep. 5, 2007

(87) PCT Pub. No.: WO2006/098178

PCT Pub. Date: Sep. 21, 2006

(65) Prior Publication Data

US 2008/0135459 A1 Jun. 12, 2008

(30) Foreign Application Priority Data

Mar. 15, 2005 (JP) ..... 2005-073643

(51) Int. Cl.
*B03C 7/00* (2006.01)

(52) U.S. Cl. ..... 209/127.1; 209/127.4

(58) Field of Classification Search ..... 209/2, 12.2, 209/127.1, 127.2, 127.3, 127.4, 134–138, 209/139.1, 140–143, 713, 714
See application file for complete search history.

(56) References Cited

U.S. PATENT DOCUMENTS

| | | | | |
|---|---|---|---|---|
| 2,360,595 | A | 10/1944 | Thompson | |
| 3,489,669 | A | 1/1970 | Ruhnke | |
| 3,755,122 | A | 8/1973 | Melcher et al. | |
| 3,765,153 | A | 10/1973 | Grey | |
| 4,172,028 | A * | 10/1979 | Dunn | 209/12.2 |
| 5,513,755 | A * | 5/1996 | Heavilon et al. | 209/2 |
| 5,518,546 | A * | 5/1996 | Williams et al. | 118/621 |
| 5,865,381 | A * | 2/1999 | Mitsumura et al. | 241/18 |
| 5,968,231 | A | 10/1999 | Parmentier et al. | |
| 6,017,381 | A | 1/2000 | Dunn et al. | |
| 6,320,148 | B1 * | 11/2001 | Yoon et al. | 209/127.3 |
| 7,119,298 | B2 * | 10/2006 | Yoshiyama et al. | 209/127.1 |

FOREIGN PATENT DOCUMENTS

| | | |
|---|---|---|
| JP | 2000-317345 | 11/2000 |
| JP | 2001-334171 | 12/2001 |
| JP | 2004-243154 | 9/2004 |

OTHER PUBLICATIONS

Extended Supplementary European Search Report (in English language) issued May 2, 2011 in corresponding European Patent Application No. 06 71 5284.

* cited by examiner

*Primary Examiner* — Pamela Rodriguez
(74) *Attorney, Agent, or Firm* — Wenderoth, Lind & Ponack, L.L.P.

(57) ABSTRACT

In an electrostatic separator or a magnetic separator, prior to electrically charging or magnetization of particles in order to carry out separation of mixed powder of particles having different properties from each other, classification is performed by a classifier so that the content of fine powder having a spherical equivalent diameter of 10 μm or smaller is 15 mass % or less. After the classification, prior to electrostatic separation or magnetic separation, an operation of dispersing the mixed powder of particles may be carried out.

5 Claims, 4 Drawing Sheets

METHOD OF SEPARATING FOREIGN PARTICLES

BACKGROUND OF THE INVENTION

1. Technical Field

The present invention relates to a separation method capable of providing an economically satisfactory separation and recovery efficiency or a removal efficiency, and of providing a concentration rate of an intended component with a sufficient level that withstands practical use thereof, in a case of carrying out separation and recovery of an intended material or carrying out separation and removal of an unnecessary component, from powders of various minerals or from powders of intermediate products or wastes discharged from a variety of industries, by using static electricity or magnetism.

2. Description of Related Art

As a method of carrying out separation and recovery of an intended material from powder containing particles with different components or materials, carrying out removal of an unnecessary material, or carrying out concentration of the intended material, there are conventionally employed various methods such as specific gravity separation, magnetic separation, and electrostatic separation, by using a difference in physical or physicochemical properties such as a specific gravity, magnetic properties (magnetism), electrical properties (dielectric constant, conductivity, and electrostatic property) of those particles. Selection from among those methods is determined based on the difference in properties between the intended material to be separated and recovered or concentrated, and the remaining unnecessary material. However, in those methods, conventionally, the separation and recovery efficiency or the concentration rate of the intended material is low in many cases, which results in a limited practical use in industry.

On the other hand, in recent years, a high emphasis is placed on separation and recovery or concentration of remaining useful materials, for dealing with depletion of resources, particularly, useful minerals, for effective use thereof, and for use and recycling of a by-product or wastes discharged from various industries. There is a strong demand for the separation and recovery efficiency and the concentration rate that are sufficient for the intended material that withstands practical use, and establishment of a technology for achieving lower equipment costs and lower running costs.

Under the circumstances, in recent years, a method using electrostatic separation and a method using magnetic separation which can be achieved with lower construction costs and with lower running costs, and which have a possibility of being applied in a wide range of fields are regarded as promising methods. However, in the related art, the separation and recovery efficiency and the concentration rate of the intended material is at a low level, and are not developed to a practical level.

For example, as a method using electrostatic separation, there are known technologies as disclosed in JP 2004-243154 A and in WO 2002/76620.

SUMMARY OF THE INVENTION

It has been discovered that significant factors other than factors conventionally and commonly known have an adverse effect on separation and recovery efficiency and separation efficiency such as concentration rate of an intended material, and hinder practical uses thereof. Therefore, the present invention provides a specific method for overcoming the cause of the impediment in order to improve the separation efficiency to a large extent with a sufficient level to withstand the practical use.

It is well known that it is necessary to perform electrostatic separation with a high degree of dryness since the moisture on a particulate surface, which has an adverse effect on a surface conductivity or contact resistance of particles, or the humidity in the air, which has an adverse effect on the moisture of a particulate surface, is an important factor which affects the separation and recovery efficiency and the separation efficiency such as the concentration rate of the intended material.

However, when an experiment is actually carried out in a dried state, it is found that a part of particles has relatively high separation efficiency, while many particles have an extremely insufficient separation efficiency which is not developed to a practical level at all.

Therefore, in order to find the factor, which affects the separation and recovery efficiency and the separation efficiency such as the concentration rate of the intended material, other than water and humidity, the inventor of the present invention has conducted research and study on operation conditions such as a type and temperature of a gas to be supplied, a gas flow rate, an applied voltage, an electric field intensity, a magnetic intensity, a magnetic gradient, and a fluidized state of a powder layer, and effects of particle size distribution, a chemical component or an absorbent on a particulate surface, and the like. As a result, it has been discovered that, in either case of the electrostatic separation and the magnetic separation, when a large amount of fine powder having a spherical equivalent diameter of 10 μm or smaller is contained in the mixed powder of particles having different properties, the separation efficiency is reduced to a large extent.

It is probable that, when a large amount of such fine powder is contained, aggregation of particles becomes significant, and the particles are aggregated in a state where the particles which are to be separated and have different properties, that is, intended material particles and unintended material particles, are mixed with each other, which results in deterioration of the separation efficiency. Through the additional research and study conducted by the inventor, it has also been discovered that even in a case where the fine powder having the diameter of 10 μm or smaller corresponds to only one of the intended material particles and the unintended material particles, the fine powder has a high adhesive/cohesive force because the fine powder is such fine powder, and is adhered also to particulate surfaces of the other particles having larger size, with the result that the electrostatic separation cannot be performed with efficiency and the separation efficiency is reduced to a large extent.

As a countermeasure against those problems, the inventor of the present invention has devised the following method. That is, in order to reduce the cohesiveness, there is employed a method of removing in advance fine powder having a spherical equivalent diameter of 10 μm or smaller, which is the cause of aggregation, by classification. In addition, after the classification, it is possible to employ a method of dispersing a mixed powder of particles and then carrying out electrostatic separation or magnetic separation of the mixed powder of particles.

According to the present invention, it is possible to recover only intended material particles with high purity (high concentration rate) and with high yield, from the mixed powder containing the intended material particles and unintended material particles. As a result, the recovered intended material particles can be efficiently used, which leads to a large contribution to the future effective use of resources and environmental measures on a global scale, from perspectives of effective use of resources, and effective use of by-product and waste.

DETAILED DESCRIPTION OF THE INVENTION

Hereinafter, a specific method according to the present invention will be described.

The present invention relates to a method of removing in advance fine powder having a spherical equivalent diameter of 10 μm or smaller, which is the cause of aggregation, to thereby reduce cohesiveness. However, from the perspective of industry, it is impossible to completely remove only the fine powder having a diameter of 10 μm or smaller.

Figure 1:
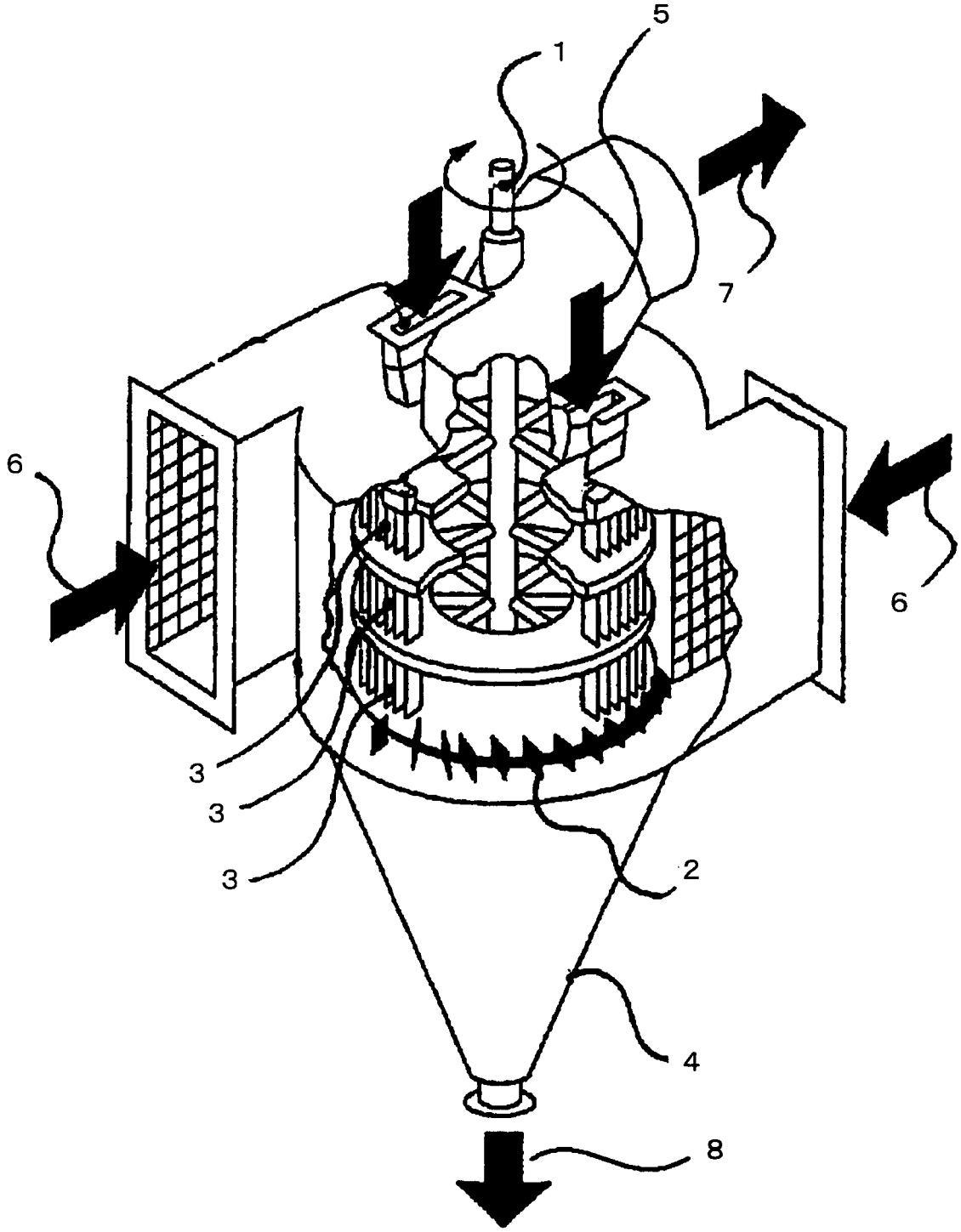
FIG. 1 is a schematic diagram showing a structure of a separator used in an embodiment of the present invention.

Accordingly, the inventor has empirically investigated the limit of content of the fine powder having the diameter of 10 μm or smaller, equal to or less than content thereof that is satisfactory from economical and industrial standpoints, by use of a classifier shown in FIG. 1. As a result, after many experiments, the following results were obtained. That is, prior to imparting an electric charge or magnetism to mixed powder (raw material powder) including properties to be separated, that is, intended material particles and unintended material particles, which are mixed therein, to separate the mixed powder, fine powder is removed by classification so that the content of fine powder having a diameter of 10 μm or smaller contained in the raw material powder, is 15 mass % or less, or desirably 10 mass % or less, and the resultant is imparted with an electric charge and supplied to a separator, with the result that the separation and recovery efficiency and the concentration rate of the intended substance are improved to a large extent.

It should be noted that in FIG. 1, reference numeral 1 denotes a rotor shaft; 2, guide vanes; 3, rotor blades; 4, a hopper; 5, a powder supply position; 6, an air inlet; 7, air and fine powder; and 8, a coarse grain outlet.

In this case, it is effective to use a dry-type classifier, but the principle of the classifier is not limited, and any type of classifier such as a centrifugal classifier and an inertia classifier may be used. On the other hand, it is preferable that a gas (air in general use) to be used for classification have lower humidity, that is, a relative humidity of 70% or lower, or desirably 50% or lower.

It should be noted that a method of adjusting the content of the fine powder having the diameter of 10 μm or smaller is determined depending on the classifier to be used. For example, in the centrifugal classifier, the method is appropriately selected based on a rotational speed of the rotor blades 3, an operation angle of the guide vanes 2, a supply amount of the gas to be used for classification, a gas flow rate, and the like, depending on the structure of the type of the classifier.

After the above-mentioned classification operation is carried out, it is more desirable to perform dispersion of the raw material powder. A method for the dispersion is not particularly limited, but the dispersion can be performed by using, for example, an ejector, a pipe, a high-speed rotary impact crusher such as a pin mill and a blade mill, a ball mill, or a medium agitating mill.

In a case of using an ejector, it is effective to supply the raw material powder into an ejector with a gas supply pressure of 100 kPa to 600 kPa at gage pressure, or into jet at the rear of the ejector. In a case of using a pipe, it is effective to supply the raw material powder into a pipe having a gas flow with a Reynolds number of 12,000 or larger. In a case of applying a high-speed rotary impact crusher to dispersion, it is effective to supply mixed powder of particles into a container having a protrusion such as pins or blades which are mounted to a rotation shaft and rotates at a circumferential speed of 5 m/s or higher. Further, in a case of applying a ball mill or a medium agitating mill to dispersion, it is desirable to supply the raw material powder into a container filled with a dispersing medium such as a ball having a spherical equivalent diameter (diameter of the ball obtained when the ball having the same volume is assumed) of 1 mm to 60 mm, or a solid whose shape is not limited, and to rotate the container or rotate a rotation shaft provided inside the container and agitation blades or agitation bars that are connected to the rotation shaft, to thereby move the dispersing medium.

Thus, by carrying out the operation of dispersion after the classification, an aggregate contained in the mixed powder of particles is disintegrated. As a result, for example, even in a case where the intended material particles and the unintended material particles are firmly agglomerated, the intended material particles and the unintended material particles can be separated from each other extremely effectively by electrostatic separation or magnetic separation.

Example 1

About 10 million tons of fly ash are generated from electric power plants across the country. From the viewpoint of the future effective use of resources, low-grade coal whose ash content is high is used in many cases, and it is expected that the yield of the fly ash is to be further increased. About 60% of the fly ash is used as a part of a raw material of cement in the production of cement, and an available quantity of the fly ash has already reached its limit from the viewpoint of a chemical component as cement. Most of the remaining fly ash is landfilled. The landfill is not desirable in view of environmental measures as a matter of course.

In order to further increase the available quantity of the fly ash in the field of cement, instead of using the fly ash as the raw material of cement, it is necessary to add and mix the fly ash to produced cement within a range as defined by Japanese industrial standards (JIS). However, under the present circumstances, unburned carbon remaining in the fly ash (when coal is burned in a thermal electric power plant, a significant percentage of unburned carbon components remains) has an adverse effect on the quality of cement or concrete. Therefore, it is impossible to add and mix the fly ash at present.

If the unburned carbon can be effectively separated and removed from the fly ash and the unburned carbon content of the fly ash can be reduced to about 0.5% or smaller, it is possible to add and mix the fly ash to cement.

Under the circumstances, electrostatic classification using a difference in electrical property between ash and carbon has been employed. However, the concentration rate of an intended material (concentration rate of ash, that is, to reduce the content of the unburned carbon contained in fly ash) and the separation and recovery efficiency (yield of fly ash) have not been developed to a practical level.

Results obtained after empirically investigating the effects of the present invention are described as follows.

In Example 1, prior to supplying fly ash having an unburned carbon content of 3.2 mass % to an electrostatic separator, a centrifugal classifier having a structure as shown in FIG. 1 was used to carry out classification, and then separation of the unburned carbon from the fly ash was performed by using the electrostatic separator. It should be noted that electrostatic separation was performed using an apparatus with an electrode interval of 65 mm, at an applied voltage of 30 kV, and in dry air (at temperature of 70° C. and relative humidity of 10%). A part of the results is shown in FIG. 2.

Figure 2:
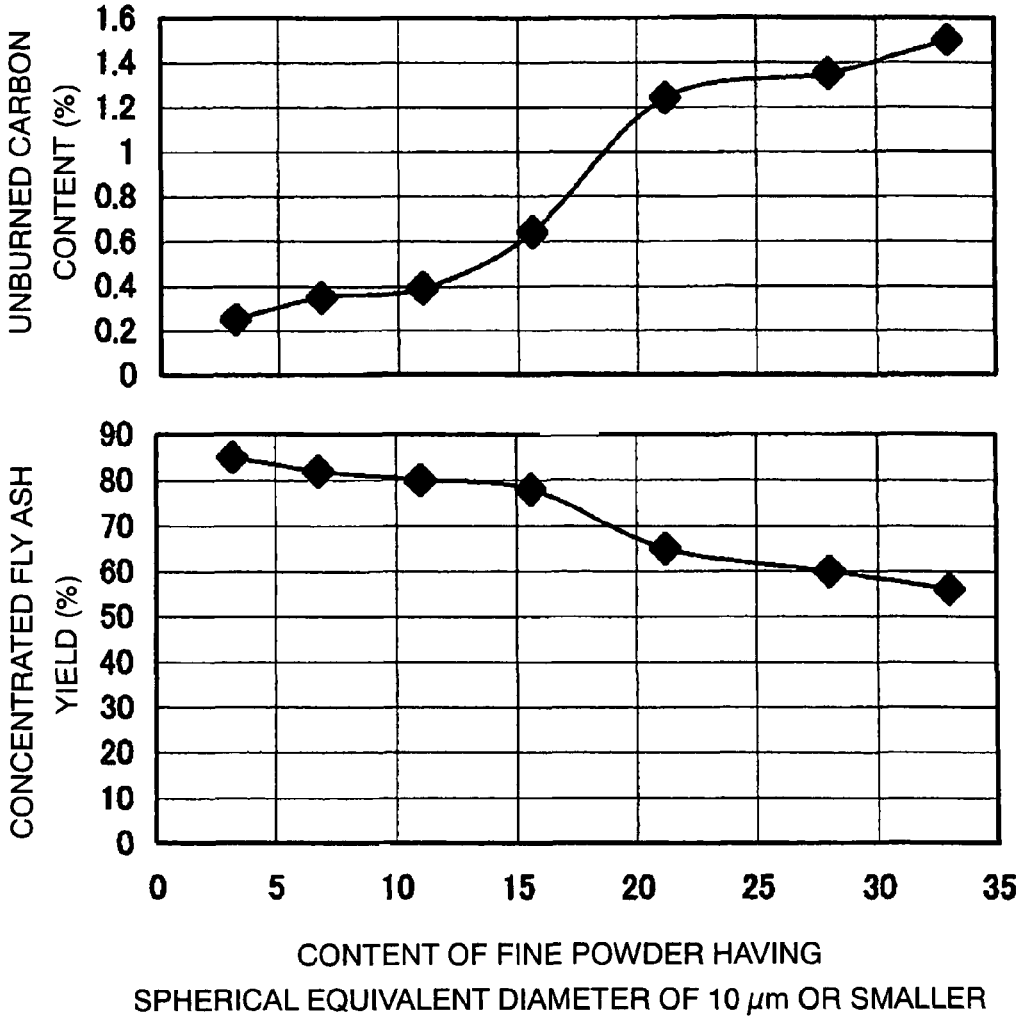
FIG. 2 is a graph showing an unburned carbon content and a concentrated fly ash yield which are obtained when fly ash is processed according to Example 1.

FIG. 2 shows a case where data indicating that the content of fine powder having a diameter of 10 μm or smaller is 33% is obtained without using the classifier, that is, the conventional case. As is apparent from the figure, when the fine powder is removed by use of the classifier and the content of fine powder having a diameter of 10 μm or smaller is reduced to a certain extent, the unburned carbon content is reduced to a large extent.

Example 2

Figure 3:
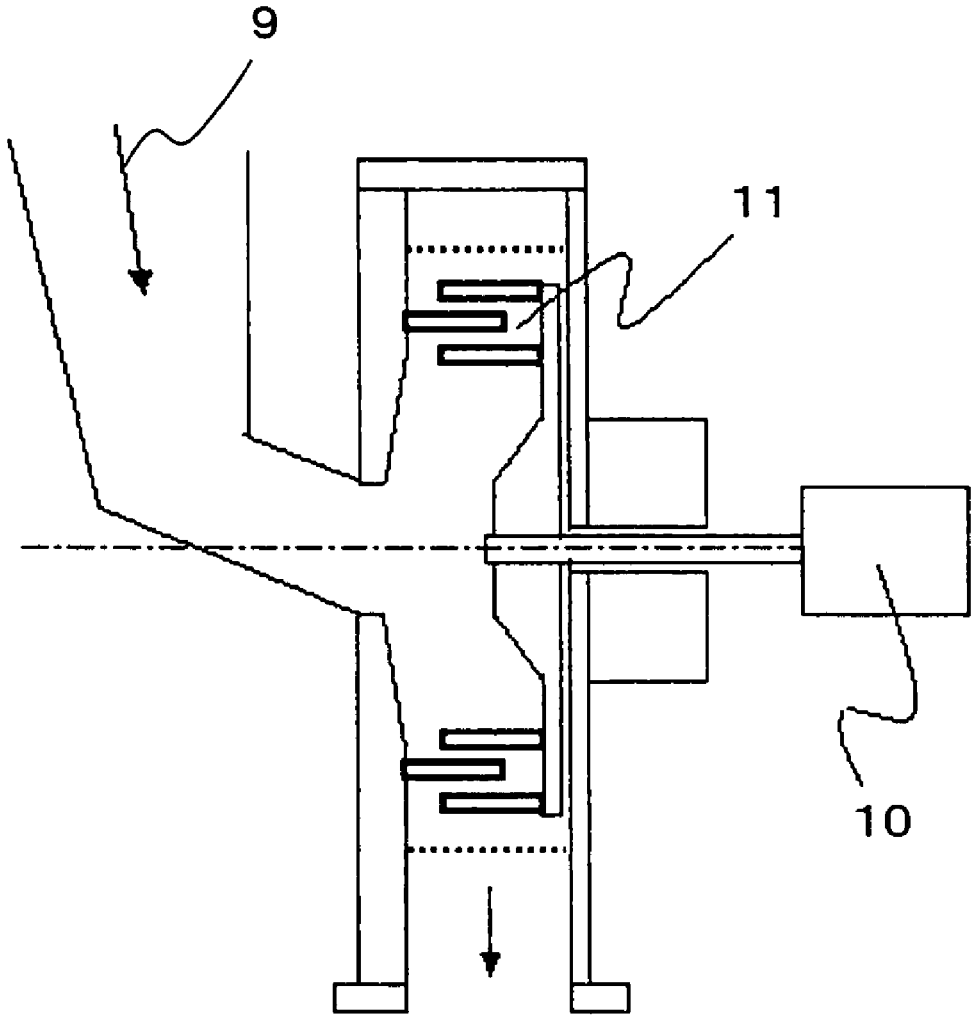
FIG. 3 is a schematic diagram showing a pin-type dispersing apparatus used in Example 2.
Figure 4:
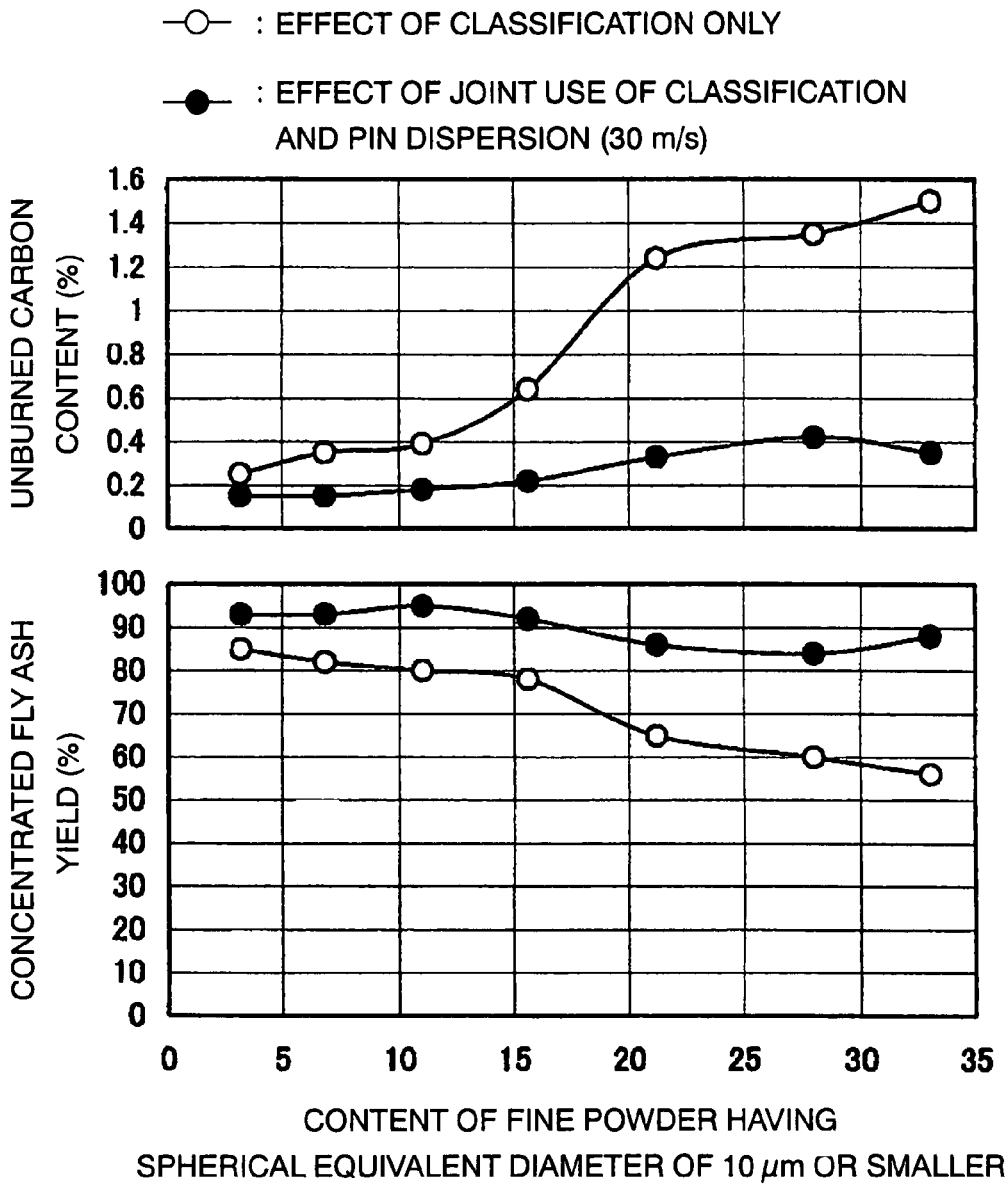
FIG. 4 is a graph showing an unburned carbon content and a concentrated fly ash yield which are obtained when fly ash is processed according to Example 2.

In Example 2, the same fly ash as that of Example 1 was used, the centrifugal classifier having the structure as shown in FIG. 1 was used to classify the fly ash, a pin-type dispersing apparatus as shown in FIG. 3 was used to disperse the fly ash, and an electrostatic separator was used, to thereby carry out the experiment. Note that in FIG. 3, reference numeral 9 denotes raw material powder; 10, a motor; and 11, pins. A rotational speed of the pins 11 was set to 30 m/s. A part of the results is shown in FIG. 4. FIG. 4 shows that, as compared to the results of Example 1, the unburned carbon content is further reduced and the concentrated fly ash yield is improved.

The invention claimed is:

1. A method of separating foreign particles, for carrying out separation of intended material particles and unintended material particles from each other from mixed powder including the intended material particles and the unintended material particles that are mixed therein and have different properties from each other, by one of electrostatic separation and magnetic separation, the method of separating foreign particles comprising the steps of:

classifying the mixed powder by using a centrifugal classifier or an inertia classifier to remove the fine powder having a spherical equivalent diameter of 10 μm or smaller so that a content of fine powder, which has a spherical equivalent diameter of 10 μm or smaller, contained in the mixed powder is 15 mass % or less; and imparting one of an electric charge and magnetism to the mixed powder, from which the fine powder has been removed, to separate the intended material particles and the unintended material particles from each other.

2. A method of separating foreign particles according to claim 1, further comprising the step of:

dispersing a particle aggregate contained in the mixed powder, from which the fine powder is removed, prior to the imparting of one of an electric charge and magnetism to the mixed powder to separate the intended material particles and the unintended material particles from each other.

3. A method of separating foreign particles according to claim 1, wherein the classifying of the mixed powder is performed so that the content of the fine powder, which has a spherical equivalent diameter of 10 μm or smaller, contained in the mixed powder is 10 mass % or less.

4. A method of separating foreign particles according to claim 1, wherein the classifying the mixed powder uses a gas having a relative humidity of 70% or lower.

5. A method of separating foreign particles according to claim 4, wherein the classifying the mixed powder uses a gas having a relative humidity of 50% or lower.

* * * * *